US005765249A

United States Patent [19]

Axelrod

[11] Patent Number: 5,765,249

[45] Date of Patent: Jun. 16, 1998

[54] TOOTHBRUSH FOR CLEANING THE TEETH OF A DOMESTIC ANIMAL

[75] Inventor: Herbert R. Axelrod, Deal, N.J.

[73] Assignee: T.F.H. Publications, Inc., Neptune City, N.J.

[21] Appl. No.: 852,520

[22] Filed: May 7, 1997

[51] Int. Cl.[6] ..... A16B 9/04

[52] U.S. Cl. ..... 15/106; 15/167.2

[58] Field of Search ..... 15/106, 167.1, 15/167.2

[56] References Cited

U.S. PATENT DOCUMENTS

| | | | |
|---|---|---|---|
| 3,146,478 | 9/1964 | Rosenthal | 15/110 |
| 4,025,982 | 5/1977 | Palmer | 15/106 |
| 5,297,310 | 3/1994 | Cox | 15/106 |

FOREIGN PATENT DOCUMENTS

| | | | |
|---|---|---|---|
| 13540 | of 1891 | United Kingdom | 15/106 |
| 293677 | 7/1928 | United Kingdom | 15/167.2 |

*Primary Examiner*—Randall E. Chin

*Attorney, Agent, or Firm*—Fulwider Patton Lee & Utecht, LLP

[57] ABSTRACT

A pet toothbrush having a pair of like toothbrushes carried by a flexible tubular holder. The bristle ends of the toothbrushes are simultaneously movable against the front and back sides of a pet's teeth as the holder flexes.

2 Claims, 2 Drawing Sheets

TOOTHBRUSH FOR CLEANING THE TEETH OF A DOMESTIC ANIMAL

FIELD OF THE INVENTION

The present invention relates generally to devices for the care of domestic animals, such as dogs and cats. More particularly, the present invention relates to a toothbrush adapted to clean the teeth of such animals.

Background of the Invention

It is well known that domestic animals such as dogs or cats should have their teeth brushed regularly to prevent the build-up of plaque and tartar which can lead to tooth loss and unpleasant breath. In many cases however, the pet owner is reluctant to personally clean the animal's teeth, particularly since most pets do not enjoy the cleaning process and attempt to avoid the same by biting, scratching or otherwise preventing a person from devoting the time necessary to thoroughly clean the pet's teeth with a toothbrush. The longer the teeth brushing operation, the more annoyed the pet becomes. Accordingly, the pet owner typically elects to take the pet to a veterinarian or professional groomer skilled in the teeth cleaning process.

SUMMARY OF THE INVENTION

The present invention is embodied in a double-handle toothbrush wherein the bristle members are spaced opposite each other so that they may be used for simultaneously brushing the inner and outer sides of a pet's teeth at the same time. Since both sides of the pet's teeth may be brushed at the same time, a considerable savings of tooth brushing time is made possible, as compared to brushing the pet's teeth with a single-handled toothbrush. The pet toothbrush of the present invention utilizes a tubular holder formed of a flexible and elastic synthetic plastic material, the opposite ends of which removably receive a pair of like toothbrushes. The free ends of the toothbrushes have bristles which face one another and the flexible nature of the tubular holder permits the intermediate portion of the tubular holder to bend freely, permitting the bristles to be manually movable towards one another by the pet owner so that the pet's teeth and gums can be simultaneously cleaned.

The pet toothbrush of the present invention further includes an elastic retainer band that is slipped over the handles of the toothbrushes to releasably retain such handles in a generally aligned parallel position for shipping and for storage between uses.

The free ends of the toothbrush handles are releasably telescopically received by the opposite ends of the tubular holder to permit either of the toothbrushes to be removed from the holder and used singularly to reach spots in the pet's mouth not reachable by the joined-together double toothbrushes. Additionally, this feature makes it possible to replace either of the toothbrushes should one toothbrush become broken or otherwise damaged.

These and other features and advantages of the present invention will become apparent from the following detailed description of a preferred embodiment which, taken in conjunction with the accompanying drawings, illustrates by way of example the principles of the invention.

DETAILED DESCRIPTION OF A PREFERRED EMBODIMENT

Figure 1:
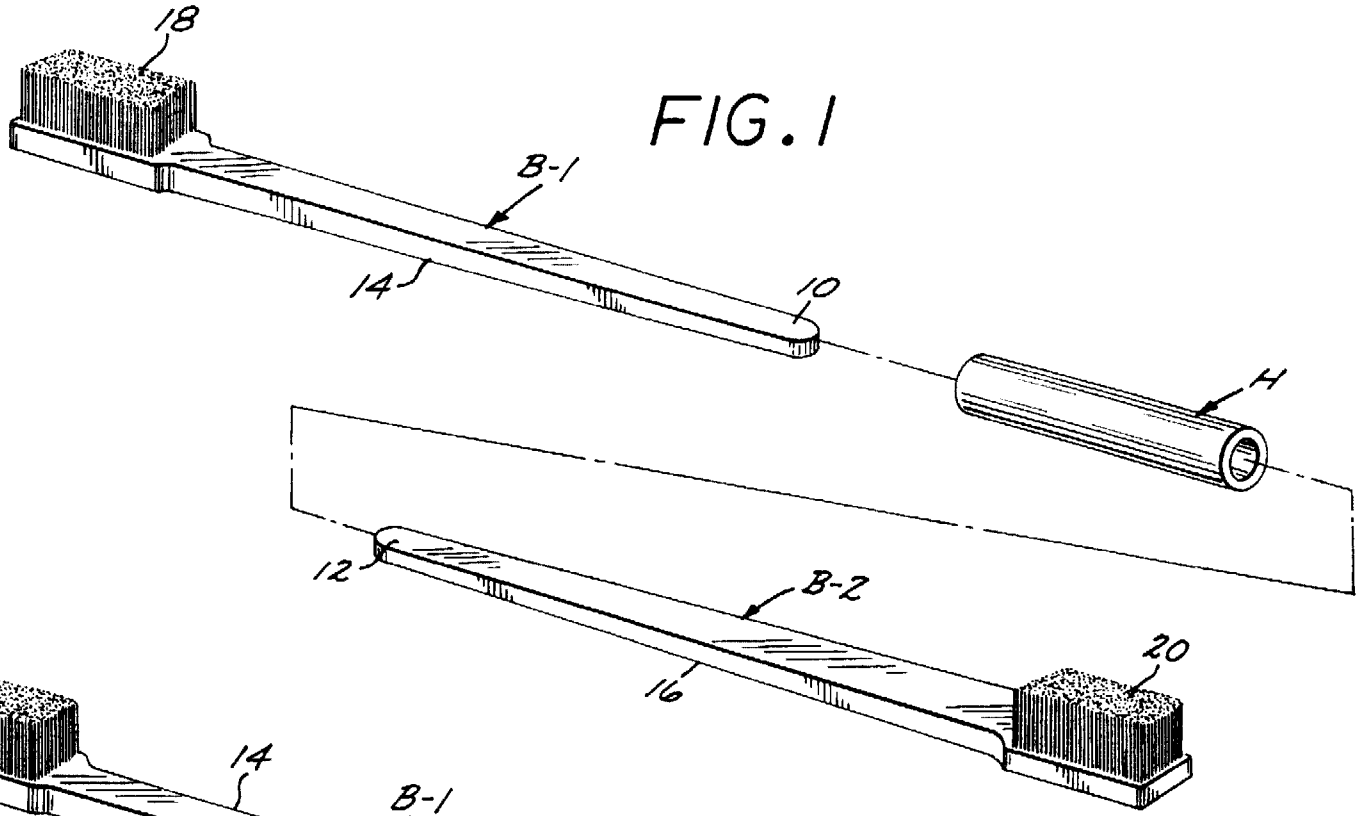
FIG. 1 is an exploded perspective view of the major parts of a pet toothbrush embodying the present invention.
Figure 2:
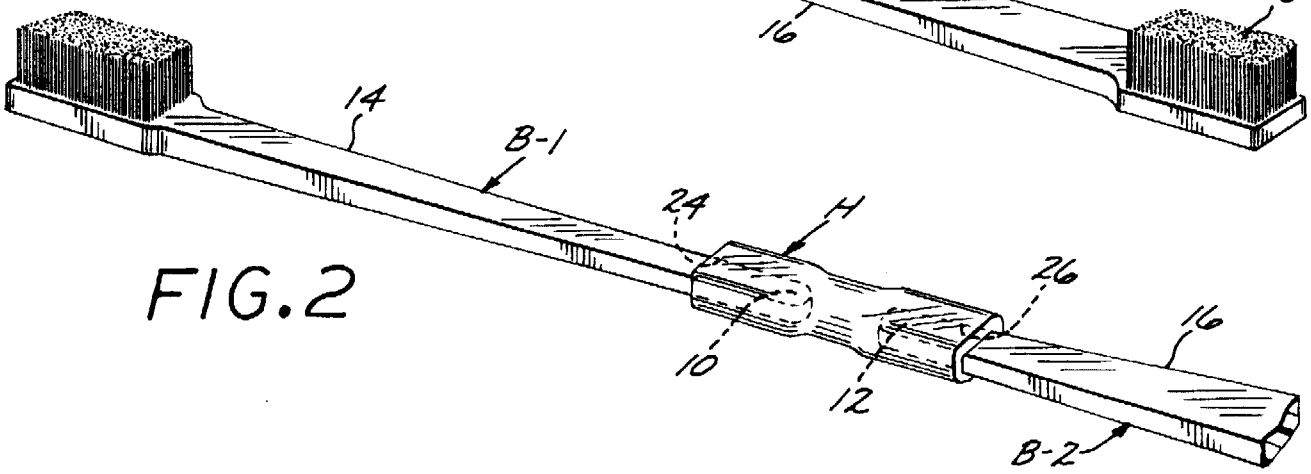
FIG. 2 is a broken perspective view of the pet toothbrush a pair of toothbrushes having their free ends received by the opposite ends of a resilient and flexible tubular holder.

A pet toothbrush embodying the present invention includes a tubular holder H formed of a resilient synthetic plastic material, such as polyethylene or polyurethane. The free ends 10 and 12 of a pair of like toothbrushes B-1 and B-2 include handles 14 and 16 that are releasably telescopically received by the opposite ends of the tubular holder H, as indicated particularly in FIG. 2. The ends of the toothbrush handles opposite their free ends are formed with bristles 18 and 20. The handles of the toothbrushes may be manually movable towards one another in order that bristles 18 and 20 may simultaneously engage and clean the front and back sides of the teeth of a pet (not shown).

More particularly, the tubular holder H may be formed of a suitable synthetic plastic such as polyethylene or polyurethane. Such plastic materials are both flexible and elastic. The elasticity permits the opposite ends of the tubular holder to stretch and thereby define sockets 24 and 26 at the opposite ends of the tubular holder to slidably telescopically receive the free ends 10 and 12 of the toothbrushes B-1 and B-2. Preferably, the handles 14 and 16 of the two toothbrushes will taper toward their free ends 10 and 12 so as to facilitate insertion and withdrawal of such free ends within the sockets 24 and 26 of the tubular holder H. When the free ends are inserted within the sockets the material of holder H will assume a generally oval configuration.

The two toothbrushes B-1 and B-2 each may conveniently be molded in one piece, with the bristles and being an integral part of their respective handles so that such bristles will not become loosened and drop into the pet's mouth. The use of polyethylene to form the toothbrushes is particularly desirable, since such material is relatively soft and will accordingly not scratch the inside of the pet's mouth. Such material is likewise inexpensive so as to reduce the cost of manufacture of the toothbrush.

Figure 3:
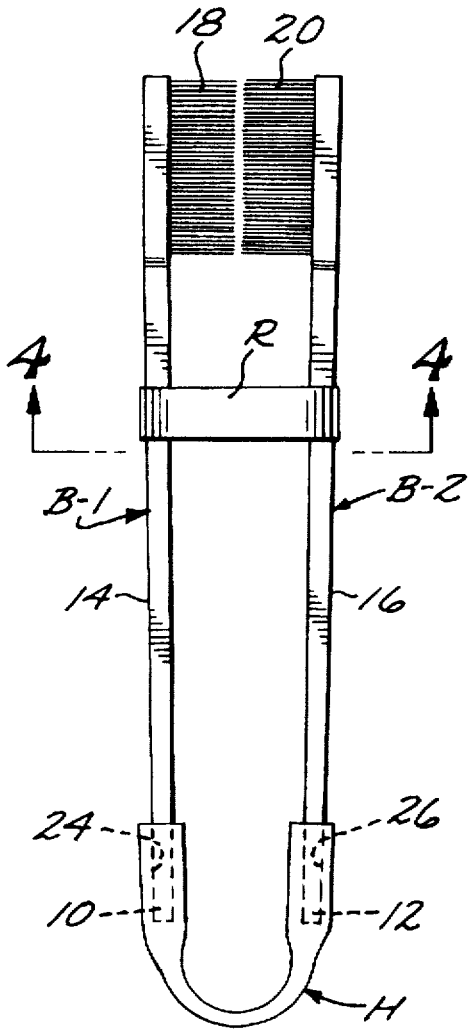
FIG. 3 is a top plan view of the pet toothbrush of the present invention.

When the pet toothbrush of the present invention is utilized to clean a pet's teeth, the user will grasp the intermediate portions of the toothbrush handles and insert the bristle ends of the toothbrush within the pet's mouth, the holder H assuming a U-shaped configuration as shown in FIG. 3. The bristles will then be urged against the inside and outside surfaces of the pet's teeth and manipulated backwards and forwards in a vertical or horizontal direction. The flexible nature of the intermediate portion of the tubular holder H permits the bristles to be moved towards one another, while urging the two toothbrushes apart when the pet owner relaxes his grip on the toothbrushes. Since both sides of the pet's teeth are cleaned simultaneously, the tooth cleaning operation can be accomplished much faster than if a single toothbrush were to be employed. Accordingly, the pet's teeth can be thoroughly cleaned before the pet becomes exasperated, such exasperation potentially resulting in biting or scratching. The construction of the toothbrush embodying the present invention, however, permits either one of the toothbrushes to be readily removable from the tubular holder member H should it be necessary to clean a portion of the pet's teeth not easily reachable when both toothbrushes are mounted in holder H.

Figure 4:
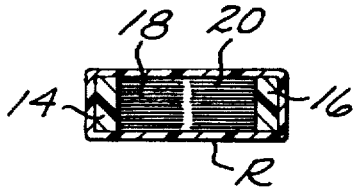
FIG. 4 is a vertical sectional view taken along line 4—4 of FIG. 3.

Referring now to FIGS. 3 and 4, the pet toothbrush embodying the present invention may be provided with a synthetic plastic retainer band R that is slipped over the tubular holder H and into engagement with the intermediate portion of the toothbrush handles 14 and 16 to releasably retain the handles in a generally parallel and aligned configuration. This permits the toothbrush to be shipped and sold in a package (not shown) having a width comparable to the width of the curved-together tubular holder H. Also, the toothbrush will occupy the least amount of space when not in use.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A toothbrush for cleaning the teeth of a domestic animal, said toothbrush comprising:

a tubular holder formed of a flexible and elastic synthetic plastic material having first and second end portions, and an intermediate portion therebetween;

a pair of like toothbrushes, each having a handle formed with a free end and a bristle end, the free ends being telescopically received by the first and second end portions of the holder member with the bristles facing one another;

with the intermediate portion of the holder member flexing to permit the handles to be manually movable towards and away from one another whereby the bristles may simultaneously engage and clean the front and back sides of the teeth of a domestic animal;

and further including a retainer band that is slipped over the handles of the toothbrushes to releasably retain the handles in a generally parallel aligned inoperative position.

2. A toothbrush for cleaning the teeth of a domestic animal, said toothbrush comprising:

a tubular holder formed of a flexible and elastic synthetic plastic material having first and second end portions, and an intermediate portion therebetween;

a pair of like toothbrushes, each having a handle formed with a free end and a bristle end, the free ends being telescopically received by the first and second end portions of the holder member with the bristles facing one another;

with the intermediate portion of the holder member flexing to permit the handles to be manually movable towards and away from one another whereby the bristles may simultaneously engage and clean the front and back sides of the teeth of a domestic animal;

a retainer band that is slipped over the handles of the toothbrushes to releasably retain the handles in a generally parallel aligned inoperative position;

wherein the free ends of the toothbrush handles are releasably retained within the first and second end portions of the holder.

* * * * *